US005802682A

United States Patent [19]

Jourde et al.

[11] Patent Number: 5,802,682

[45] Date of Patent: Sep. 8, 1998

[54] BRUSH CONVEYOR AND NEEDLING MACHINE EQUIPPED WITH SAME

[75] Inventors: Bernard Jourde, Elbeuf; Francois Louis, La Saussaye, both of France

[73] Assignee: Asselin, Elbeuf, France

[21] Appl. No.: 860,932

[22] PCT Filed: Jan. 12, 1996

[86] PCT No.: PCT/FR96/00050

§ 371 Date: Jul. 11, 1997

§ 102(e) Date: Jul. 11, 1997

[87] PCT Pub. No.: WO96/21761

PCT Pub. Date: Jul. 18, 1996

[30] Foreign Application Priority Data

Jan. 12, 1995 [FR] France ..... 95 00291

[51] Int. Cl.[6] ..... D04H 18/00

[52] U.S. Cl. ..... 28/107; 198/803.14

[58] Field of Search ..... 28/107, 108, 109, 28/110, 111, 112, 113, 114, 115; 198/803.14, 803.15, 803.01

[56] References Cited

U.S. PATENT DOCUMENTS 4,651,393 3/1987 Dilo et al. ..... 28/111
5,117,541 6/1992 Leuchtenmüller ..... 28/115
5,473,802 12/1995 Dilo ..... 28/107

FOREIGN PATENT DOCUMENTS 2525643 10/1983 France ..... 28/107
2657093 7/1991 France ..... 28/107

*Primary Examiner*—C. D. Crowder
*Assistant Examiner*—Larry D. Worrell
*Attorney, Agent, or Firm*—Greer, Burns & Crain, Ltd.

[57] ABSTRACT

A brush conveyor, in particular for a velvet needle loom, includes an assembly of adjacent brushes forming a conveying plane and moving in a predetermined conveying direction. Each brush includes a body that is substantially elongated along a main axis, and each lower brush surface includes means for connecting the brush to a mechanical drive device while the upper brush surface has holes for receiving tufts of bristles. The brushes are arranged within the conveyor in such a way that their main axes are parallel to each other and lie at a predetermined angle to a transverse direction which is perpendicular to the conveying direction. The conveyor may be used in needle looms for making nonwoven articles.

13 Claims, 4 Drawing Sheets

FIG. 2
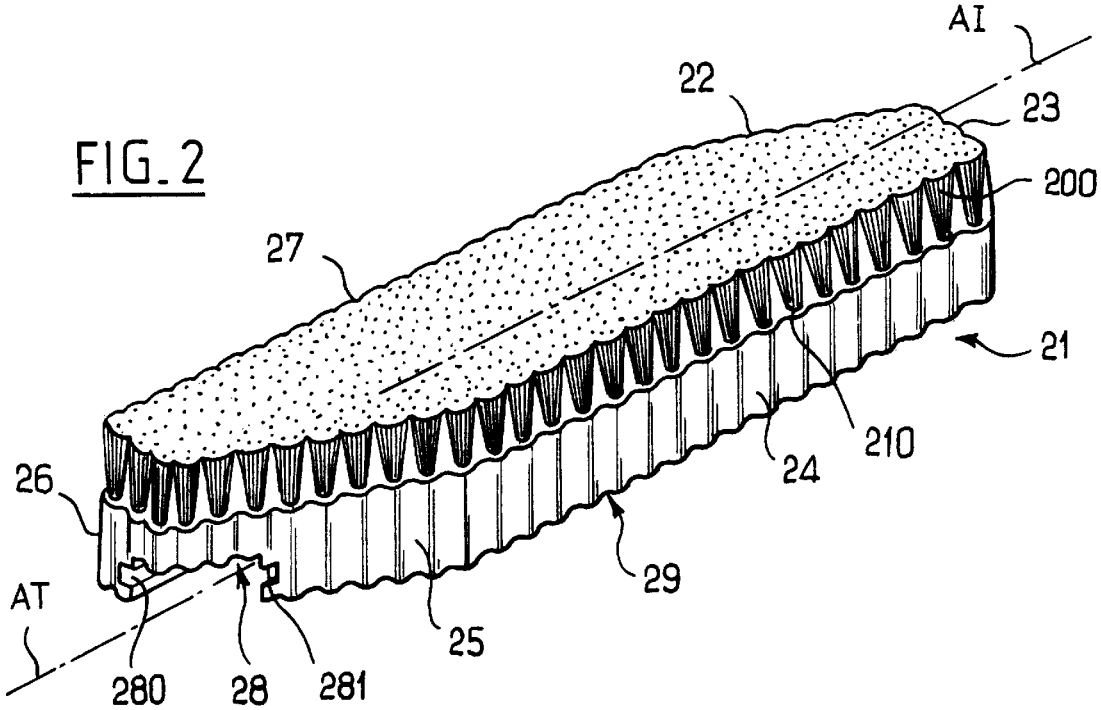
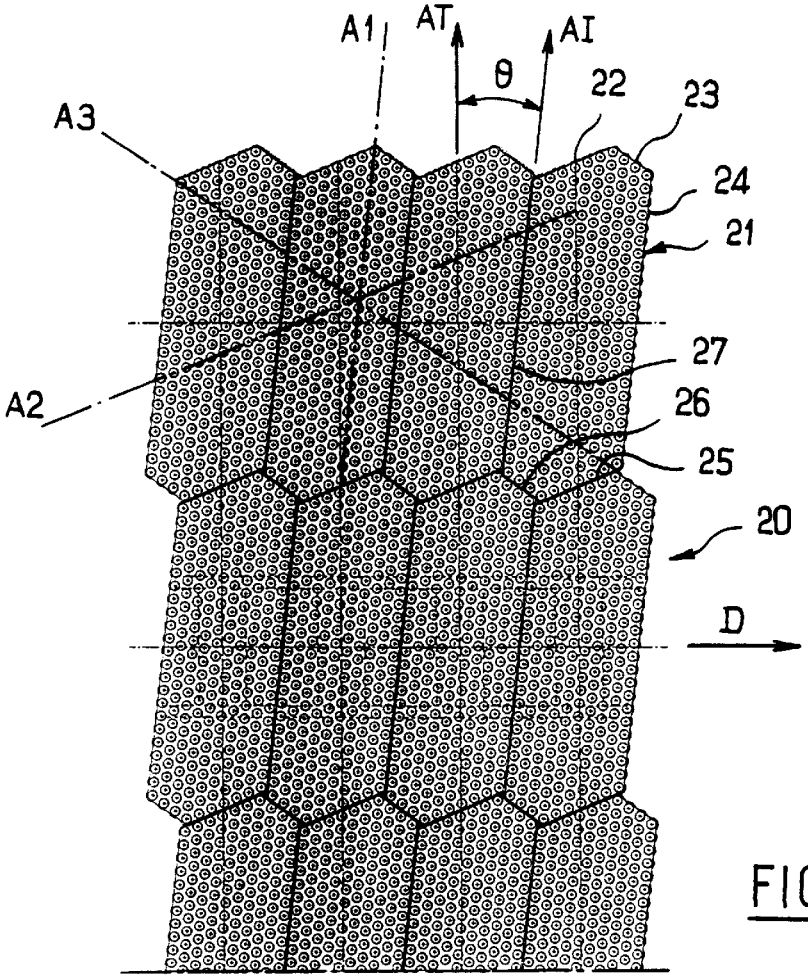
FIG. 2A

BRUSH CONVEYOR AND NEEDLING MACHINE EQUIPPED WITH SAME

BACKGROUND OF THE INVENTION

The present invention relates to a brush conveyor. It also relates to a needling machine equipped with such a conveyor.

Velvet needling machines comprise a brush conveyor whose function is to carry and drive a cloth of textile fibers under a steel plate called a stripper and provided with perforations through which a set of needles penetrate alternately into the cloth and into the brushes of the conveyor. The articulated brushes of this conveyor receive, during the needling, within their tufts of hair, fibers driven by the needles and thus contribute to the obtaining of a textile product having a surface state of the velvet type. In conveyors of the prior art, the brushes, of substantially parallelepipedic shape, are oriented and aligned perpendicularly to the direction of movement of the cloth of fibers. These alignments create line markings in the direction perpendicular to the direction of movement of the cloth. Furthermore, the clearances between the brushes create line markings in the other direction. Furthermore, on each brush, the tufts of hair are aligned both with the direction of movement and in the perpendicular direction. Because of the difference in the strength of the tufts at their center in comparison with that at their periphery, this can generate an appearance defect in the textile product known as marbling. The problem which has just been described for a brush conveyor fitted to a velvet needling machine, can also be encountered in other textile machines using brushes.

SUMMARY OF THE INVENTION

The purpose of the invention is to overcome these 35 disadvantages by proposing a brush conveyor which makes it possible to obtain a textile product having a surface isotropy which is better than that obtained with the conveyors of the prior art, and to eliminate the line markings.

According to the invention, the brush conveyor, comprising an assembly of contiguous brushes constituting a conveying plane moving in a predetermined conveying direction, each brush comprising a body whose shape is substantially elongated along a principal axis and comprising on its lower face means of connecting the brush to a mechanical drive device and on its upper face holes for receiving tufts of hair and disposed in rows which are substantially parallel with the principal axis, is characterized in that the brushes are disposed in the conveyor in such a way that their principal axes are parallel and inclined by a predetermined angle with respect to the direction perpendicular to the conveying direction.

Thus, in a conveyor according to the invention, the brushes are no longer aligned in the direction perpendicular to the direction of movement of the product. It becomes possible to provide a regular installation of tufts of hair whilst avoiding the creation of alignments of tufts which would be parallel with or perpendicular to the direction of conveying or of movement, experience having shown that the existence of such alignments contributed to the arising of marking defects in the product.

In a particular embodiment, the brush conveyor furthermore comprises, as a drive device, an assembly of belts driven by drive means and, as a means for the mechanical connection of the brushes to the drive device, an assembly of connecting rails disposed perpendicular to the conveying direction and integral with the belts, each rail being designed to receive one transverse row of contiguous brushes.

Each brush furthermore comprises, in its body, a slide designed to receive a connecting rail, this slide being oriented with respect to the principal axis of the brush in such a way that the brush has a predetermined angle of inclination with respect to the axis perpendicular to the conveying direction.

According to another aspect of the invention, there is proposed a needling machine comprising needling means provided for causing a set of needles to penetrate, with an alternating motion, through a stripper and into a cloth of fibers supported and driven by a brush conveyor according to the invention.

BRIEF DESCRIPTION OF THE DRAWINGS

Other features and advantages of the invention will furthermore appear in the following description. In the accompanying drawings, given as non-limitative examples

FIG. 2 is a perspective view of an example of a brush used in a conveyor according to the invention;

FIG. 2A shows a first example of assembling inclined brushes of the type shown in FIG. 2 for a conveyor according to the invention;

DETAILED DESCRIPTION OF THE INVENTION

Figure 1:
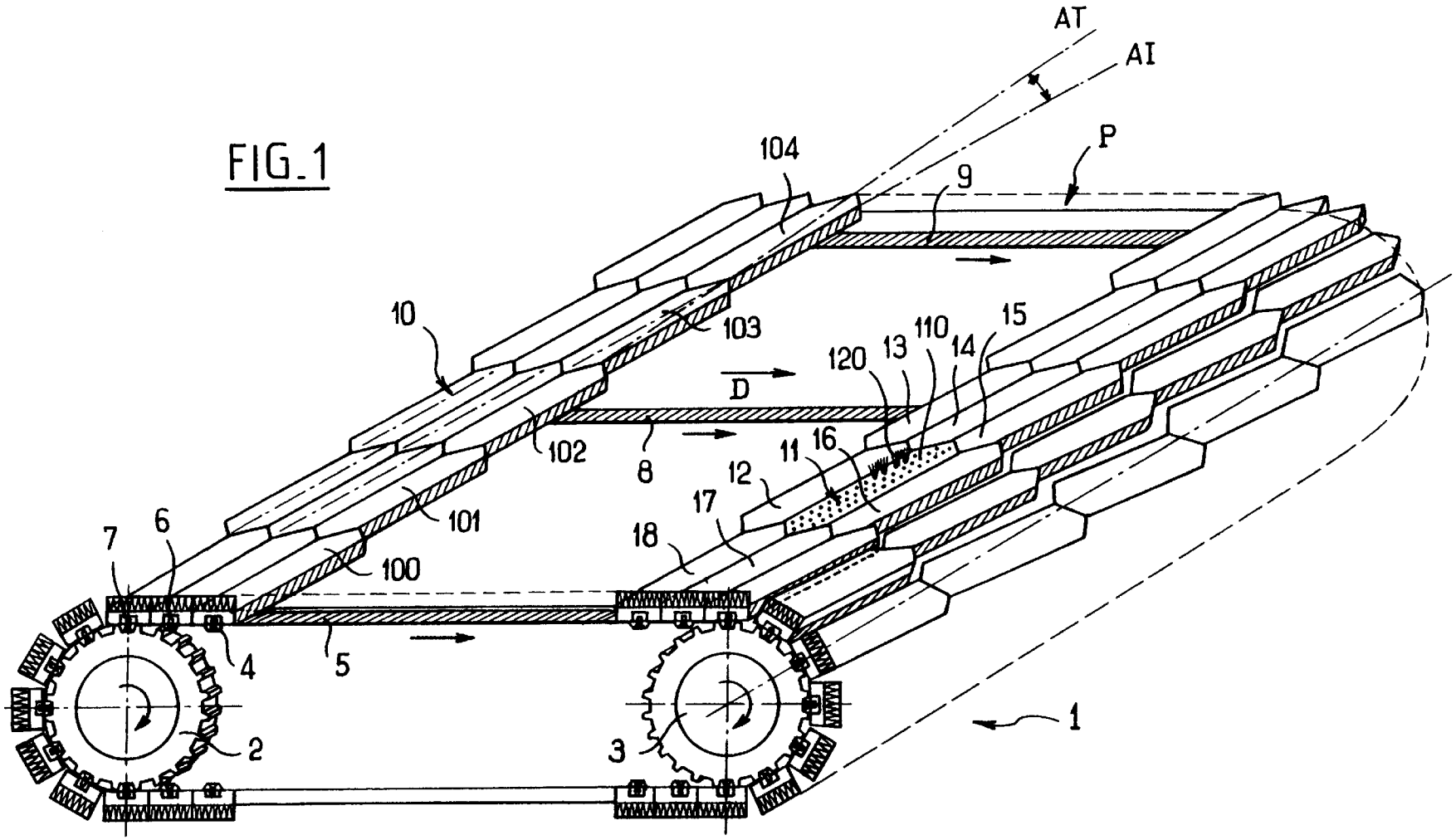
FIG. 1 is an exploded perspective view of a conveyor comprising inclined brushes, for a needling machine according to the invention.

There will now be described an embodiment of a conveyor according to the invention, with reference to FIG. 1, and several types of brushes which can be used in this conveyor, with reference to FIGS. 2 to 6.

A brush conveyor 1 can comprise, by way of non-limitative example, two drive cylinders 2, 3 provided for driving several belts 5, 8, 9. To these belts are attached connecting rails 4, 6, 7 disposed transversely with respect to the direction of movement or conveying D. Each of these rails each traverse a row 100–104 of contiguous brushes transversely. The assembly 10 of the brushes of the conveyor forms, between the two drive cylinders 2, 3, a conveying plane P for which the least possible clearance between the brushes is sought in order to obtain a faultless surface state in the needled product. For reasons of clarity in FIG. 1, only the bodies of the brushes have been shown. In the embodiment shown, these brush bodies have an elongated hexagonal shape and are designed to allow the easy fitting together of contiguous bodies and so that the rotation of the transverse rows of brushes does not raise any problems at the level of the drive cylinders 2, 3. A brush body 11, on which are normally inserted tufts of hair 120, is surrounded by six other brushes. Each brush body has a principal axis Al inclined at an angle θ with respect to the transverse direction AT perpendicular to the direction of movement D. In practice, this angle of inclination can be chosen to be less than 10 degrees.

In a first embodiment, with reference to FIG. 2, a brush 21 comprises a body 29 comprising on its upper face an assembly of holes 210, each one provided for receiving a tuft of hair 200, and on its lower face a longitudinal recess forming a slide 281 provided for receiving a connecting rail of the profiled type. This slide preferably comprises lateral housings 280, 281 provided for receiving keys when all of the brushes of a same transverse row have been coupled to the connecting rail. The axis of this slide is parallel with the transverse direction AT perpendicular to the direction of movement D, whilst the principal axis A1 of the brush, with which the longitudinal rows of receiving holes are parallel, is itself inclined by the angle of inclination θ with respect to the transverse direction AT. In the embodiment shown in FIG. 2, the body 29 is of elongated hexagonal shape and comprises undulating lateral edges 22, 23, 24, 25, 26, 27 which closely match with the receiving holes located at the periphery of the body 29. These lateral edges provide a kind of interlocking of contiguous brushes without hindering the rotation of the latter around the drive cylinders.

The receiving holes can be disposed on the upper face of a brush body 21 at the nodes of a centered hexagonal network, whereby each hole is equidistant from its adjacent hole, as illustrated in FIG. 2A which partially shows a conveying plane 20 consisting of an assembly of inclined brushes of hexagonal shape. These inclined brushes have a principal axis A1 which constitutes the common direction of the longitudinal rows of receiving holes and is inclined by an angle of inclination θ with respect to the transverse direction AT. With the hexagonal arrangement of the holes and the inclination of the brushes, the principal axis A1, A2, A3 of the rows of holes are neither parallel with nor perpendicular to the direction of displacement D.

Figure 3:
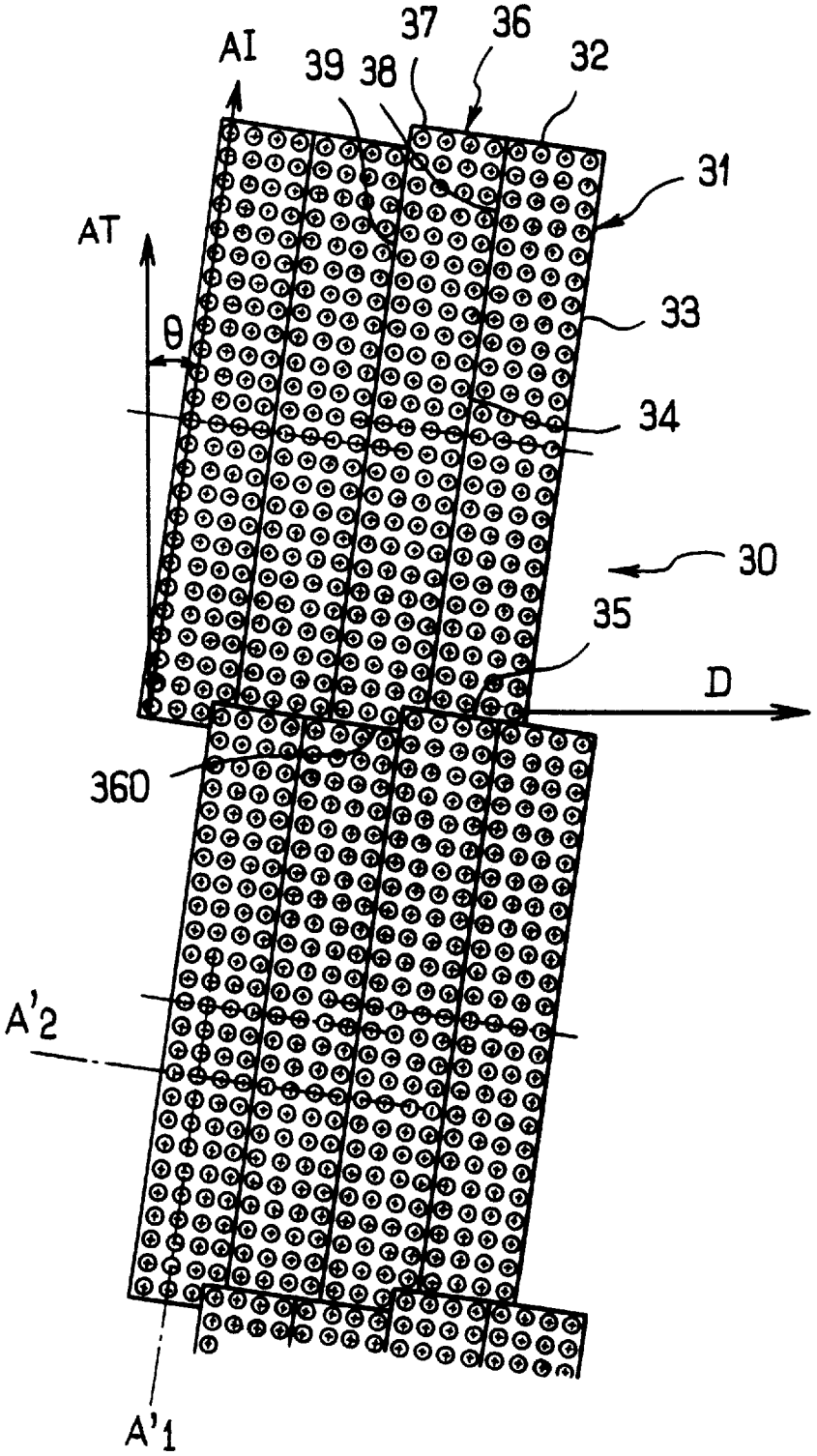
FIG. 3 shows a second example of inclined brushes for a conveyor according to the invention.
Figure 4:
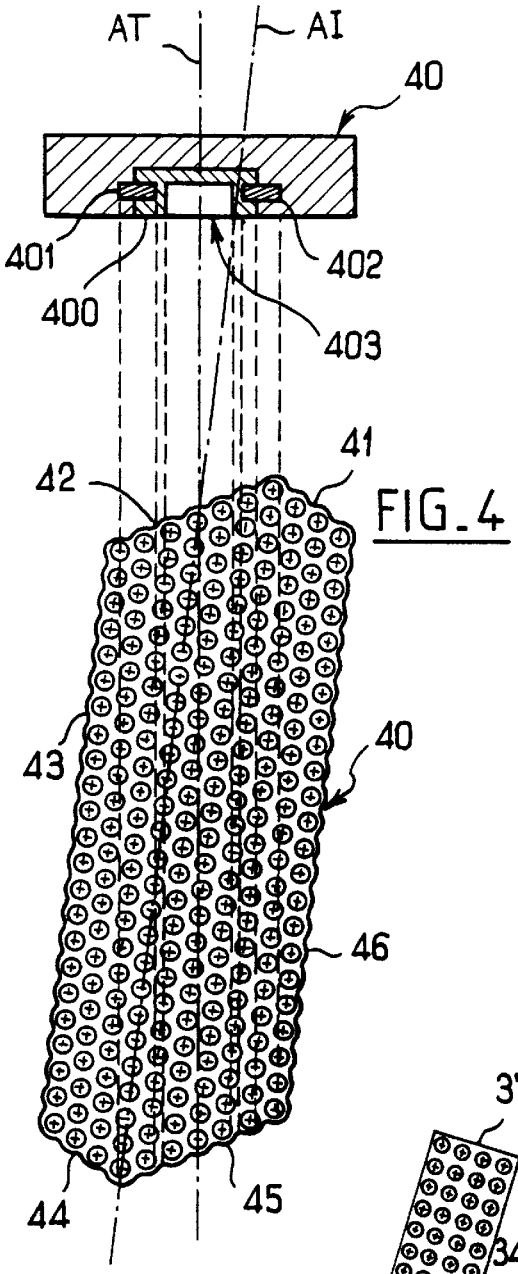
FIG. 4 shows a particular method of attaching a brush according to FIG. 2 in a conveyor according to the invention.
Figure 5:
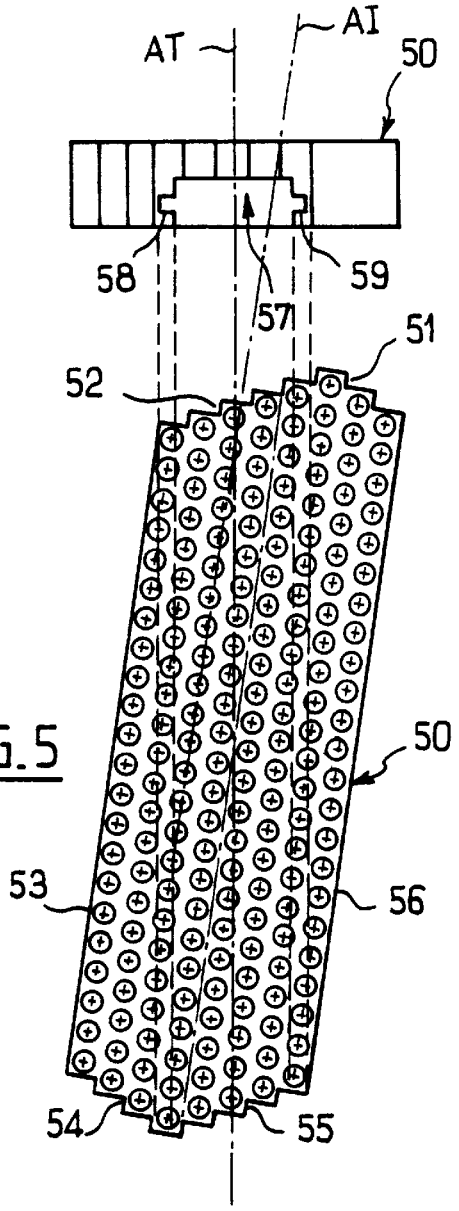
FIG. 5 shows a particular method of attaching a brush according to FIG. 3 in a conveyor according to the invention.
Figure 6:
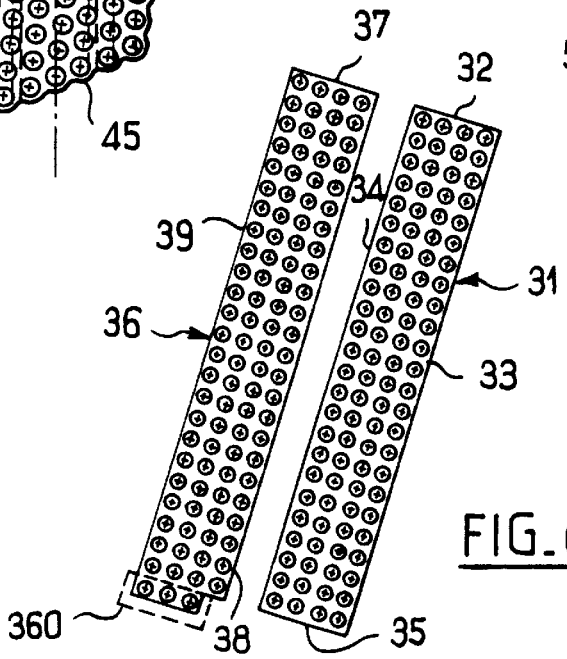
FIG. 6 illustrates a third example of inclined brushes for a conveyor according to the invention.

In a second embodiment, referred to in FIGS. 3 and 6, a conveying plane 30 consists of the assembly of brushes having two body shapes. A first body shape 31 is rectangular, this body comprising on its upper face longitudinal rows of holes parallel with the principal axis A1 of the brushes which is inclined by an angle of inclination θ with respect to the transverse direction AT. A second body shape 36 comprises a rectangle having the same dimensions as those of the first body shape to which is added an additional truncated row of holes 360 comprising, for example, one hole less than the other rows. The lateral edges 32–25, 37–39 are smooth and the receiving holes are disposed on the upper face of each brush in such a way that they occupy the nodes of a square network. The brushes are juxtaposed in order to form a continuous conveying plane. This layout configuration has two principal axes A'1, A'2 which are neither parallel with nor perpendicular to the direction of displacement D, because of the inclination of the principal axis A1 of the brushes.

Whatever the shape of the brush bodies in question may be, it is possible to provide a method of fixing the brushes to a drive device, which uses a rail around which an assembly of brushes is fitted which will constitute a transverse row. Thus, a brush body 40 having undulating lateral edges 41–46 comprises, with reference to FIG. 4, a recess 403 along the entire length of this body 40. This recess has a principal axis A1 inclined with respect to the transverse axis AT and serves as a slide to receive a connecting rail 400 of the profiled type and keys 401, 402 in appropriate housings.

It is possible to use an equivalent method of attachment for brushes whose body 56 has parallel and smooth longitudinal and lateral edges 53, 56, and ends of substantially triangular shape, the corresponding lateral edges 51, 52, 54, 55 being castellated in order to render the receiving holes located at the periphery of the body contiguous. This body 56 also has a recess 57 provided for receiving a connecting rail of the profiled type and keys in appropriate housings 58, 59. The principal axis of this recess A1 is also inclined with respect to the transverse axis AT.

The invention is not of course limited to the examples which have just been described and numerous developments can be applied to these examples without departing from the scope of the invention. Thus, shapes could be provided other than those described for the brush bodies. In particular, the number of rows and of holes on a body can be any number and is not limited by the present invention. The same applies to the number of brushes and to the arrangement of these brushes. The angle of inclination can be chosen according to considerations of the quality of the needled product on the basis of tests or of simulations. Furthermore, it is possible to envisage holes of any shape, in particular holes of circular, elliptical or even oblong shape, and various methods of attaching the tufts of hair inside the holes of the brush bodies, for example by stapling, gluing or by welding.

We claim:

1. A brush conveyor, comprising an assembly of contiguous brushes constituting a conveying plane moving in a predetermined conveying direction, each brush comprising a body whose shape is substantially elongated along a principal axis and comprising on its lower face means for connecting the brush to a mechanical drive device and on its upper face holes for receiving tufts of hair, said holes being disposed in rows which are substantially parallel with the principal axis of the brush, the brushes being disposed in the conveyor in such a way that their principal axes are parallel with each other and inclined by a predetermined angle with respect to a transverse direction perpendicular to the conveying direction.

2. The brush conveyor according to claim 1, characterized in that the body of each brush is of elongated hexagonal shape and has, at each end, substantially triangular shapes, which are complementary and arranged in such a way as to allow a contiguous assembly of brushes in the conveying plane.

3. The brush conveyor according to claim 2, characterized in that the body of each brush comprises undulating lateral edges closely matched with the receiving holes located on borders of the upper face of the brush, the undulating lateral edges of contiguous brushes being arranged to form a continuity of the conveying plane.

4. The brush conveyor according to claim 2, characterized in that the body of each brush comprises principal lateral edges which are substantially smooth and end lateral edges which are castellated, the castellated lateral edges of contiguous brushes being arranged to form a continuity of the conveying plane.

5. The brush conveyor according to claim 1, characterized in that it furthermore comprises a first assembly of brushes each having a body of rectangular shape and a second assembly of brushes each having a body of rectangular shape corresponding to a body of the first assembly to which is added a truncated row of receiving holes, and in that the conveying plane consists of an alternation of brushes of the first and second assemblies respectively, the ends of contiguous brushes interlocking in order to form a substantially continuous conveying plane.

6. The brush conveyor according to claim 1, characterized in that, in each brush body, the receiving holes are disposed in rows parallel with the principal axis of the brush and occupy nodes of a planar network of squares.

7. The brush conveyor according to claim 1, characterized in that, in each brush body, the receiving holes are disposed in rows parallel with the principal axis of the brush and occupy nodes of a planar network of hexagons, such that each hole is equidistant from its adjacent holes.

8. The brush conveyor according to claim 1, characterized in that it furthermore comprises, as a drive device, an assembly of belts driven by drive means and, as means of mechanical connection of the brushes to the drive device, an assembly of connecting rails disposed perpendicular to the conveying direction and integral with the belts, each rail being designed to receive a transverse row of contiguous brushes.

9. The brush conveyor according to claim 8, characterized in that each brush furthermore comprises, in its body, a slide designed to receive a connecting rail, this slide being oriented with respect to the principal axis of the brush such that this brush exhibits a predetermined angle of inclination with respect to the transverse direction perpendicular to the conveying direction.

10. The brush conveyor according to claim 9, characterized in that each slide comprises at least one housing for receiving, after fitting a row of brushes to a connecting rail, at least one key.

11. The brush conveyor according to claim 1, characterized in that it comprises brushes whose tufts of hair are fixed in the holes by gluing.

12. The brush conveyor according to claim 1, characterized in that it comprises brushes whose tufts of hair are fixed in the holes by welding.

13. A velvet needling machine comprising needling means for causing an assembly of needles to penetrate with an alternating motion through a stripper and into a cloth of fibers supported and driven by a brush conveyor, said brush conveyor comprising an assembly of contiguous brushes constituting a conveying plane moving in a predetermined conveying direction, each brush comprising a body whose shape is substantially elongated along a principal axis and comprising on its lower face means for connecting the brush to a mechanical drive device and on its upper face holes for receiving tufts of hair, said holes being disposed in rows which are substantially parallel with the principal axis of the brush, the brushes are disposed in the conveyor in such a way that their principal axes are parallel to each other and inclined by a predetermined angle with respect to a transverse direction perpendicular to the conveying direction.

* * * * *